US005606909A

United States Patent [19]

Ohta et al.

[11] Patent Number: 5,606,909

[45] Date of Patent: Mar. 4, 1997

[54] APPARATUS FOR WINDING TAPE

[75] Inventors: Yoshinobu Ohta; Kenichi Taniguchi, both of Yokkaichi, Japan

[73] Assignee: Sumitomo Wiring Systems, Ltd., Yokkaichi, Japan

[21] Appl. No.: 360,221

[22] Filed: Dec. 20, 1994

[30] Foreign Application Priority Data

Dec. 28, 1993 [JP] Japan ..... 5-350003

[51] Int. Cl.[6] ..... B65B 27/10

[52] U.S. Cl. ..... 100/8; 29/755; 100/1; 100/33 R

[58] Field of Search ..... 100/1, 8, 33 R, 100/33 PB; 29/755

[56] References Cited

U.S. PATENT DOCUMENTS

| | | | |
|---|---|---|---|
| 4,265,687 | 5/1981 | Mercer et al. | 100/33 R |
| 5,127,159 | 7/1992 | Kudo et al. | 29/863 |
| 5,205,329 | 4/1993 | Suzuki et al. | 29/755 |
| 5,229,178 | 7/1993 | Zemitis | 100/1 |
| 5,355,787 | 10/1994 | Burns et al. | 100/33 PB |

FOREIGN PATENT DOCUMENTS

| | | | |
|---|---|---|---|
| 0083159 | 7/1983 | European Pat. Off. | 100/8 |
| 0302804 | 2/1989 | European Pat. Off. . | |
| 87342 | 6/1966 | France | 100/8 |
| 64-63285 | 3/1989 | Japan . | |
| 1-313872 | 12/1989 | Japan . | |

*Primary Examiner*—Stephen F. Gerrity
*Attorney, Agent, or Firm*—Anthony J. Casella; Gerald E. Hespos

[57] ABSTRACT

A plurality of wires W are caused to hang downward substantially in U-shape, such that the ends of wires W to be bound together are closely fixed. The end portions of a plurality of fixed wires W are positioned in the vertical direction by straightener 16 and holder 17 and automatically bound with tape by tape winder 18. The binding position can be determined in the vertical direction, thereby obviating the need to lay wires W over their entire lengths in the conveying direction of the production line. As a result, the distance to lay wires W can be shortened by the hanging amount of wires W, thereby considerably reducing the space required for the installation of the wire binding apparatus.

10 Claims, 6 Drawing Sheets

F: FORWARD, B: BACKWARD, U: UPWARD, D: DOWNWARD, C: CLOSE, O: OPEN

APPARATUS FOR WINDING TAPE

BACKGROUND OF THE INVENTION

1. Field of the Invention

The present invention relates to method and apparatus for winding tape and, more particularly to method and apparatus for winding tape, which are optimal for the partial binding of a wiring harness.

2. Description of the Prior Art

A wiring harness is an electric wiring system which is incorporated into an automotive vehicle, a copier, etc. and generally includes a multitude of electric wires, terminals and connectors.

Since the wiring harness may include a multitude of circuits depending upon the kind of product incorporating it, it is not easy to assemble a final harness at one time. Thus, normally, the following production process has been employed to obtain the final harness. Specifically, the wiring harness is divided into a plurality of intermediate wire assemblies. After fabricating the respective intermediate wire assemblies, they are combined and bound.

Each intermediate wire assembly is, preferably, fabricated by way of a peeling step in which the insulation of each end of an electric wire cut into a specified length is peeled, a cramping step in which a terminal is cramped with the core of the electric wire exposed by the peeling step, and a terminal inserting step in which the cramped terminal is inserted into a connector housing (see, for example, Japanese Unexamined Patent Publication No. 1-313872).

There are cases where the partial binding is required: portions of the wires constituting the intermediate wire assembly (generally portions of wires connected with one single terminal) are bound with tape near their ends.

It is preferable to automatically carry out the partial binding in view of automatizing the fabrication of the intermediate wire assembly. There have been proposed methods and apparatuses for automatically binding bundles of wires constituting the intermediate wire assembly with tape (also known as "taping").

For example, Japanese Unexamined Patent Publication No. 1-313872 discloses the art of binding bundles of wires constituting the intermediate wire assembly with tape.

Japanese Unexamined Patent Publication No. 64-63285 discloses the following construction: the ends of cut wires are held by clamps secured on a conveyor extending in a predetermined conveying direction and partial binding is carried out for the wires composing the intermediate wire assembly while conveying the held wires which are laid over their entire lengths on the conveyor in the predetermined conveying direction.

The above publications disclose no specific construction for an automatic partial binding, which is, therefore, at present manually carried out. However, manual binding disadvantageously causes the quality of the products to largely vary and the defect rate to become worse.

The construction disclosed in the latter publication No. 64-63285 may enable the automatization of the partial binding to a certain extent. However, since the wires comprising the intermediate wire assembly are laid over their entire lengths on the conveyor to carry out the partial binding, a long conveying path is required. In the case of a harness of large size, the installation for the production line is required to become larger, accordingly. This is not practical because of its high production cost.

In view of the problems residing in the prior art, it is an object of the present invention to provide method and apparatus for winding tape, which enable the automatization of the partial binding in a process of producing an intermediate wire assembly needed to be partially bound without increasing the size of the production line.

SUMMARY OF THE INVENTION

In order to avoid the above problems, a tape winding method as described herein comprises the steps of closely fixing ends of wires to which binding is to be applied, hanging the wires from the fixed ends, gripping the wires in the vicinity of the position to be bound, and automatically winding the positioned portion of the wires with tape to bind the wires.

According to the subject method, ends of the wires are fixed and the wires are then aligned to hang downward, in particular, in U-shape. Positioned portions of a plurality of wires are gripped adjacent the ends thereof and are automatically bound with tape, in particular, after being positioned in the vertical direction.

The tape winding method may further comprise the step of gripping the wires on both sides of the positioned portions to be bound.

A further embodiment of a tape winding method may also comprise the step of straightening the wires before binding.

A further preferred embodiment of the invention may perform the straightening by gripping the wires adjacent, preferably, below the position to be bound with straightening means and moving the straightening means away from the fixed ends, preferably, downwards.

The wires may be connected with corresponding connector housings retained by a housing retaining mechanism, such that the housing retaining mechanism is adapted to hold the wires by way of the connector housings, and such that the binding is applied in a state where the wires are held by the housing retaining mechanism.

The wires may be connected with the connector housings on the housing retaining mechanism, and thereby the intermediate portions of the wires hang downward, in particular, substantially in U-shape. The wires hanging downward from the housing retaining mechanism are bound, with the result that the partial binding can be carried out using a waiting period between the connecting step of connecting the wires with the connector housings for one intermediate wire assembly and the next connecting step for the next intermediate wire assembly.

An inventive tape winding apparatus for solving the above problems comprises holding means for gripping a plurality of wires hanging from their fixed ends in the vicinity of wire portions to be bound, and tape winding means for automatically winding the held wires at the portions with tape.

Preferably, in partially binding a plurality of wires having the intermediate portions hanging downward in U-shape and fixed ends, the straightening means first straightens the portions of the plurality of wires adjacent the ends thereof downward. The end portions of the wires are positioned in the vertical direction between the ends thereof and the straightening means. In this state, the holding means bundles and hold the wires, with the result that the wires are fixedly positioned. The end portions of the bundled wires are automatically bound with tape by the tape winding means.

The straightening means of the apparatus holds the straightened wires in cooperation with the holding means.

These two means are opposed to each other in the vertical direction and the tape winding means is disposed therebetween. Thus, the portions of the wires to be bound can be more accurately and fixedly positioned.

In a preferred embodiment of the invention, the holding means and/or the straightening means are provided with driving means, respectively, which in particular allow for a gripping of the wires with at least two different holding forces.

As described above, it is preferred that the portions of wires hang downward from the at least one fixed end, respectively, in particular in U-shape, wherein the ends of the wires to be bound are closely fixed. The binding position is determined along the vertical direction. This obviates the need to lay the wires over their entire lengths in the conveying direction of the production line. The distance required to lay wires W can be shortened by the hanging amount of the wires W, thereby considerably reducing the space required for the installation of the wire binding apparatus.

Preferably, the partial binding can be carried out utilizing a waiting period between a connecting step required to form one intermediate wire assembly and a connecting step required to form the next intermediate wire assembly on a housing retaining mechanism. This advantageously leads to improvement in the production efficiency of the production line.

With the inventive apparatus, the binding operation is automatically carried out while the wires are hanging from their fixed ends. An embodiment of the invention demonstrates, in particular, the effect that since the binding position from the ends of the wires can be firmly maintained, the automatic binding can be carried out more easily.

Preferably, since the positions of the wires where the binding is to be applied or is applied can be accurately fixed, tape can be wound with improved accuracy and a defect rate of the products can be reduced. Particularly, since the straightener and holder are disposed in vertical relationship and the tape winder is disposed therebetween, the straightener can also operate as a holding member. This leads to a reduction in the number of the parts and securely reinforces the holding force of the holder.

BRIEF DESCRIPTION OF THE DRAWINGS

Hereafter, one preferable embodiment of the invention is described in detail with reference to the accompanying drawings, in which.

DETAILED DESCRIPTION OF THE PREFERRED EMBODIMENT

Figure 2:
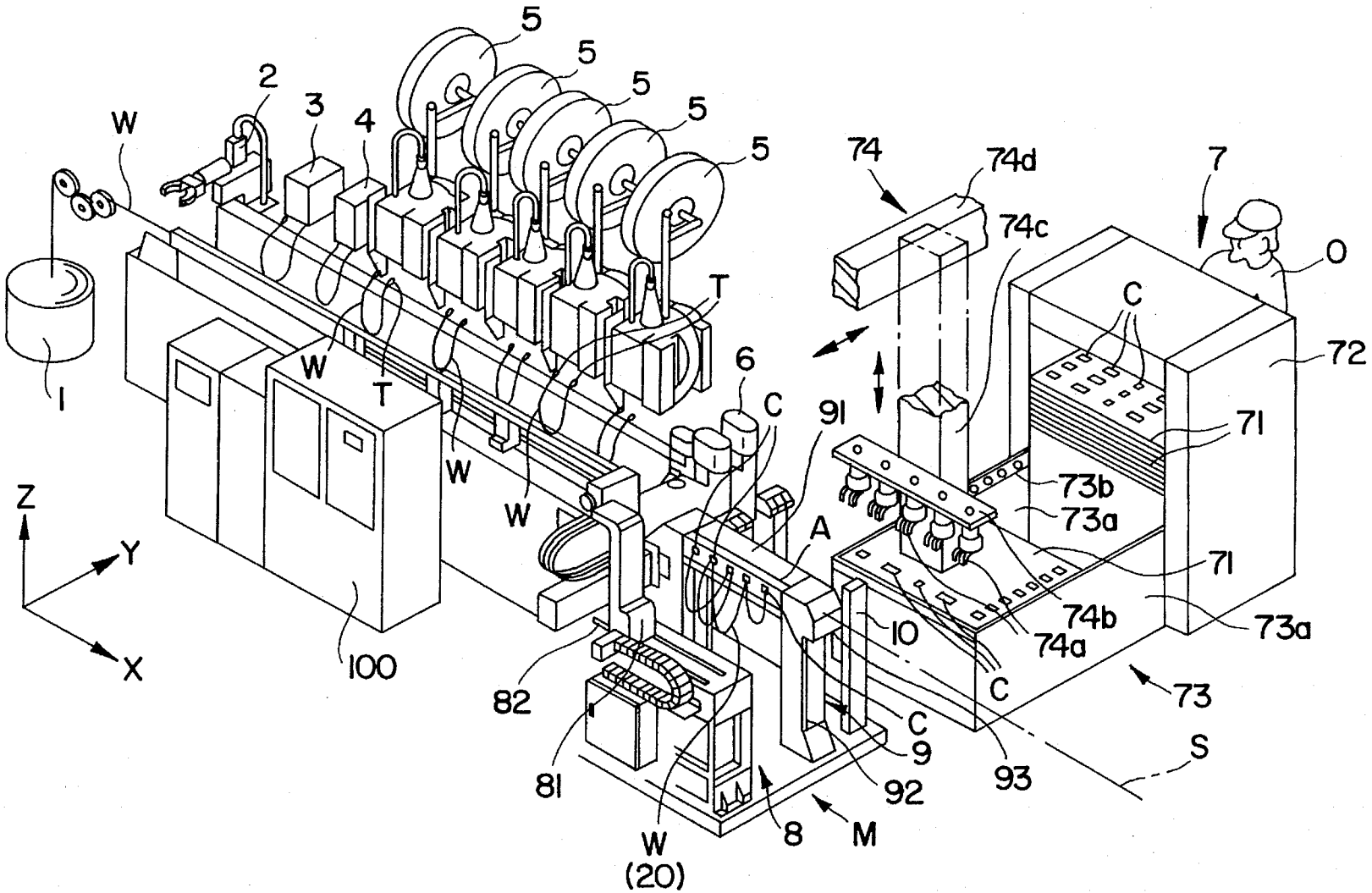
FIG. 2 is a schematic perspective view showing the producing apparatus.

With reference to FIG. 2, the apparatus for producing the intermediate wire assembly is provided with cutting device 2, conveying device (not shown), peeling device 3, peeling detector 4, terminal cramping devices 5, and wire transfer device 6. Cutting device 2 draws out insulated electric wire W from winding 1, cuts drawn wire W into a specified length, and holds both ends of cut wire W so that the intermediate part thereof hangs downward substantially in U-shape. The conveying device conveys wires W cut by cutting device 2 one after another while holding both ends thereof. Peeling device 3 peels off the insulation of the ends of each wire W conveyed by the conveying device. Detector 4 detects whether or not the peeling has been properly performed. Cramping devices 5 selectively cramp a plurality of terminals T on the peeled portion of each wire W. Hereafter, transfer device 6 displaces each wire W on which terminals T are cramped while holding its both ends to a terminal inserting mechanism 8.

In this embodiment, the producing apparatus is further provided with terminal inserting mechanism 8 for inserting terminals T of wire W received from transfer device 6 into predetermined connector housings C. This mechanism 8 includes connector feeder 7 for feeding connector housings C and assembling apparatus M for inserting terminals T into connector housings C. It should be appreciated that a direction in which wires W are transported is referred to as an X-direction, a direction normal to the X-direction on the horizontal plane a Y-direction, and a direction normal to both the X- and Y-directions a Z-direction in the description made hereinbelow.

Connector feeder 7 employs palette 71 carrying a multitude of connector housings C. Palette 71 is designed to array connector housings C necessary to produce one intermediate wire assembly in a row extending along the X-direction so as to prevent an error in feeding connector housings C and to accurately position connector housings C. Several rows in the X-direction are, in particular, arrayed in the Y-direction in the form of columns on one palette 71. Along one column of palette 71 are arrayed, in particular, identical connector housings C.

A multitude of palettes 71 are horizontally contained in palette shelves 72. As shown in FIG. 2, operator O is enabled to arrange a variety of connector housings C in accordance with the determined layout of palette 71 behind palette shelves 72.

In order to transport palette 71 carrying connector housings C, palette transport mechanism 73 projecting forward in the Y-direction is provided adjacent to shelves 72. Transport mechanism 73 includes a pair of side walls **73*a* which extend in the Y-direction and are opposed to each other in the X-direction, Rail 73*b* for supporting palette 71 is secured at the upper part of the inner surface of each side wall 73*a* (only one of rails 73*b* is illustrated). Palette 71 is reciprocally movable along the Y-direction on rails 73*b***.

Housing conveying device 74 is provided above palette transport mechanism 73. Housing conveying device 74 includes a multitude of holding arms **74*a* for holding the individual connector housings C. Respective holding arms 74*a* are selectively secured and aligned in the X-direction on support 74*b* at the positions corresponding to the respective columns of the array of housing carrying positions on palette 71**, so that they can pick up all connector housings C in one row to be conveyed at one time with one stroke.

Support **74*b* is movable upward and downward along pillar 74*c* extending in the Z-direction. Pillar 74*c* is mounted on and displaceable in the Y-direction along beam 74***d*. In cooperation with support 74*b*, pillar 74*c* and beam 74*d*, holding arms 74*a* are enabled to hold, at one time, one row of connector housings C on palette 71 transported by palette transport mechanism 73 and to convey them to the assembling apparatus M.

Figure 1:
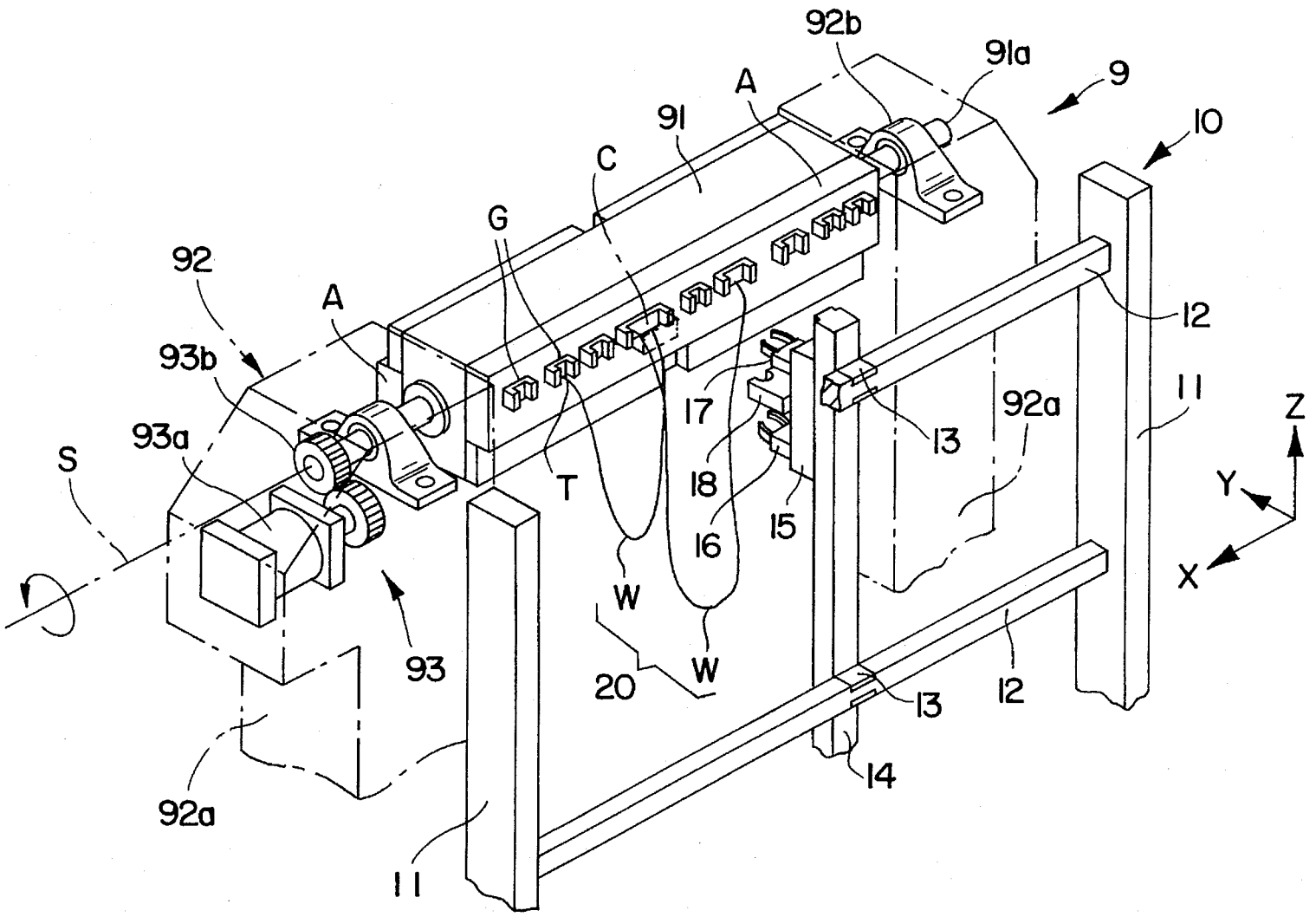
FIG. 1 is a schematic perspective view showing an essential portion of an apparatus for producing an intermediate wire assembly of a wiring harness, the apparatus incorporating a tape winding apparatus as one embodiment of the invention.

With reference to FIGS. 1 and 2, assembling apparatus M is provided with housing retaining mechanism 9 for retaining a plurality of connector housings C fed from connector feeder 7.

Retaining mechanism 9 includes housing retaining plates A, mount member 91 on which retaining plates A are mounted, support member 92 for rotatably supporting mount member 91 about horizontal axis S parallel with the X-direction, and driving device 93 (see FIG. 1) for rotating mount member 91 about horizontal axis S by 180° at a specified timing.

Retaining plates A are each adapted to retain a plurality of connector housings C at specified intervals in parallel with horizontal axis S. Positioning gadget G is disposed at each of the retained positions of connector housings C on the surface of retaining plate A. Connector housings C are positioned by means of positioning gadgets G on retaining plate A. Further, a locking gadget (not shown) is mounted on each positioning gadget G so as to lock positioned connector housing C.

Mount member 91 is a member in the form of a square pillar extending in the X-direction. Mount member 91 has a surface opposed to housing feeder 7 in the Y-direction and another surface opposed in the reversed direction. Retaining plate A is detachably mounted and positioned on each of the above two surfaces by means of an unillustrated pin or like positioning member. An unillustrated cylinder for driving the locking gadgets of retaining plate A is mounted on mount member 91.

As clearly shown in FIG. 1, support shaft 91*a* extending in the X-direction projects from the opposite longitudinal end faces of mount member 91. Mount member 91 is rotatably supported by support member 92 by way of support shaft 91*a* and bearings 92*b* for rotatably supporting support shaft 91*a*.

Support member 92 includes a pair of support columns 92*a* opposed to each other in the X-direction at a specified distance. Mount member 91 is arranged between support columns 92*a*.

Driving device 93 is built in support member 92. Driving device 93 transmits a rotational force of rotary actuator 93*a* to support shaft 91*a* of mount member 91 by means of gear mechanism 93*b* to thereby rotate mount member 91 by 180° each time. Mount member 91 is automatically rotated upon completion of a partial binding step to be described later. Each time mount member 91 is rotated by 180°, it is positioned by means of a pin or like positioning member.

As described above and clearly shown in FIG. 2, assembling apparatus M is further provided with terminal inserting mechanism 8 for tightly holding wire W and terminals T transferred from wire transfer device 6 and inserting terminals T into predetermined connector housings C carried by retaining plate A.

Inserting mechanism 8 includes movable table 81 which is reciprocally movable in the X-direction and terminal inserting head 82 which is supported on movable table 81 and is movable in the Y- and Z-directions. Terminal inserting head 82 moves to connector housing C while tightly holding the opposite ends of wire W, thereby inserting terminals T attached to wire W into predetermined connector housing C.

Figure 6B:
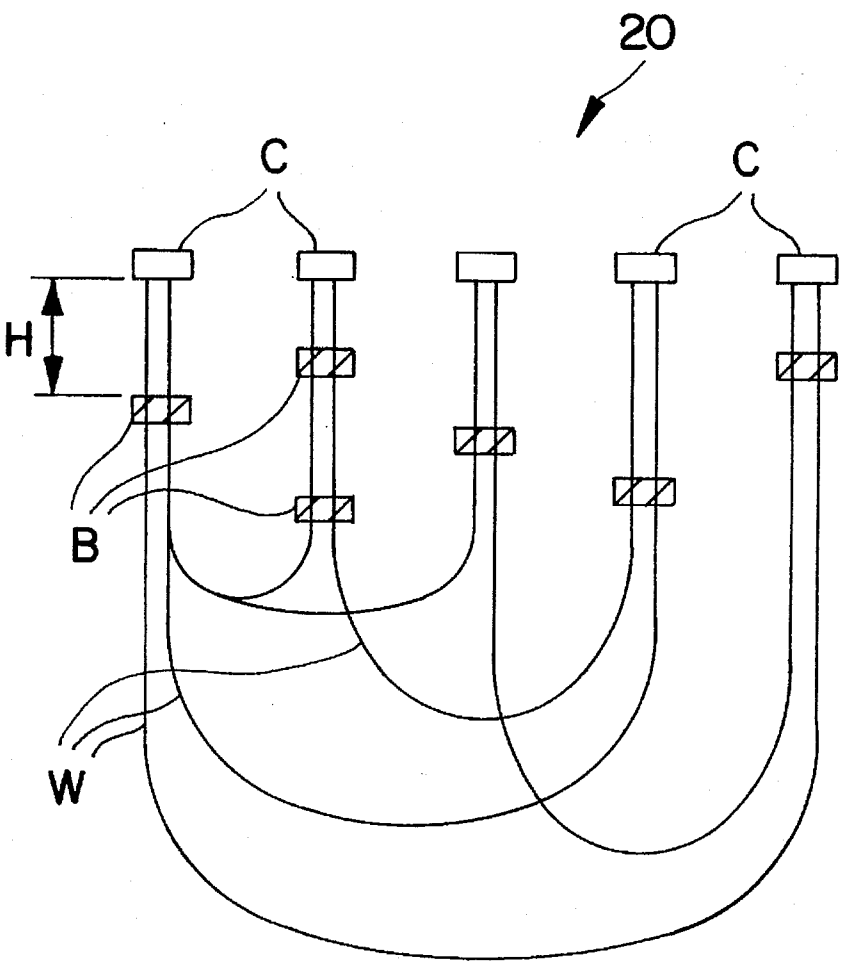
FIGS. 6(A) and 6(B) are schematic diagrams of an intermediate wire assembly in the embodiment before and after a partial binding step, respectively.
Figure 6A:
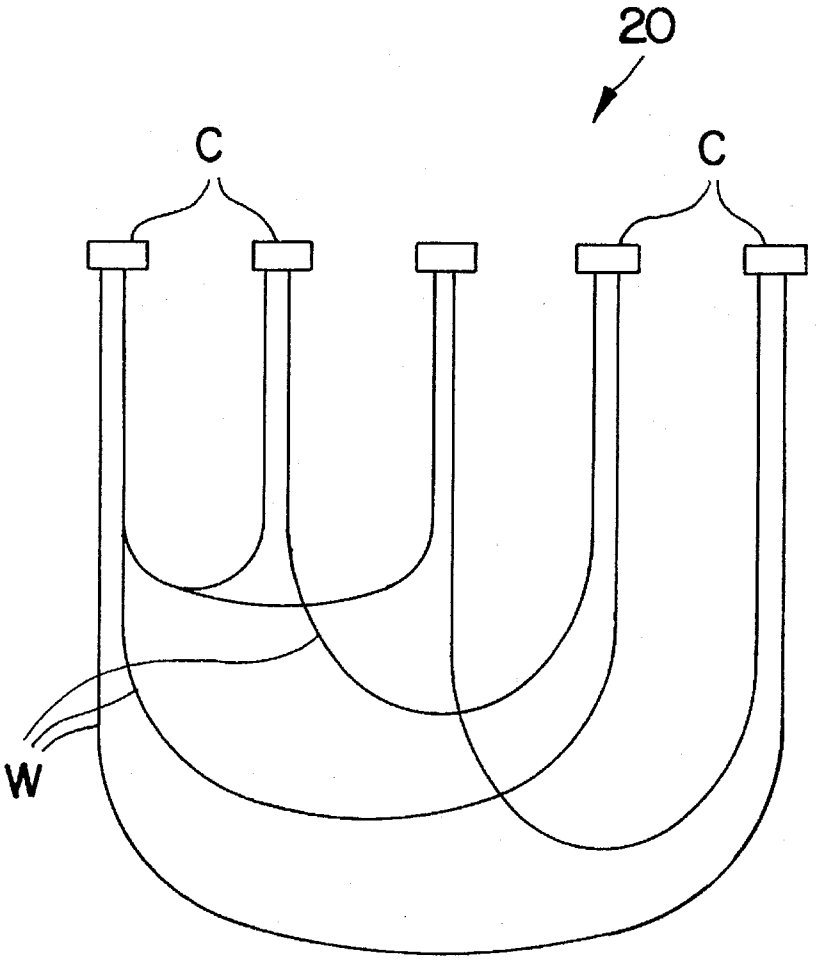

When terminals T are inserted into the specified connector housings C by means of the inserting mechanism 8, the wires W, terminals T and connector housings C constitute intermediate wire assembly 20 as shown in FIG. 6(A). The opposite ends of each wire W connected with corresponding connector housing C are fixed at housing retaining mechanism 9 and the intermediate portion thereof hangs downward in U-shape. Tape winding apparatus 10 of this embodiment operates in the state shown in FIG. 6(A) and applies binds B to intermediate wire assembly 20 as shown in FIG. 6(B).

As shown in FIG. 2, tape winding apparatus 10 is disposed between housing retaining mechanism 9 and palette transport mechanism 73 and is opposed to retaining mechanism 9 along the line defined by the Y-direction.

As clearly shown in FIG. 1, tape winding apparatus 10 includes a pair of columns 11 opposed to corresponding support columns 92*a* of housing retaining mechanism 9 along the Y-direction, a pair of guide frames 12 transversely extending between columns 11, X-direction movable member 14 in the form of a frame which is movably mounted on guide frames 12 in the X-direction by way of rail guides 13, and Z-direction movable member 15 in the form of a block which is movably mounted on movable member 14 in the Z-direction. Each of movable members 14 and 15 is provided internally with an unillustrated known drive mechanism and is driven to move in a corresponding direction by a specified moving distance in accordance with a control signal from controller 100 to be described later.

Figure 3:
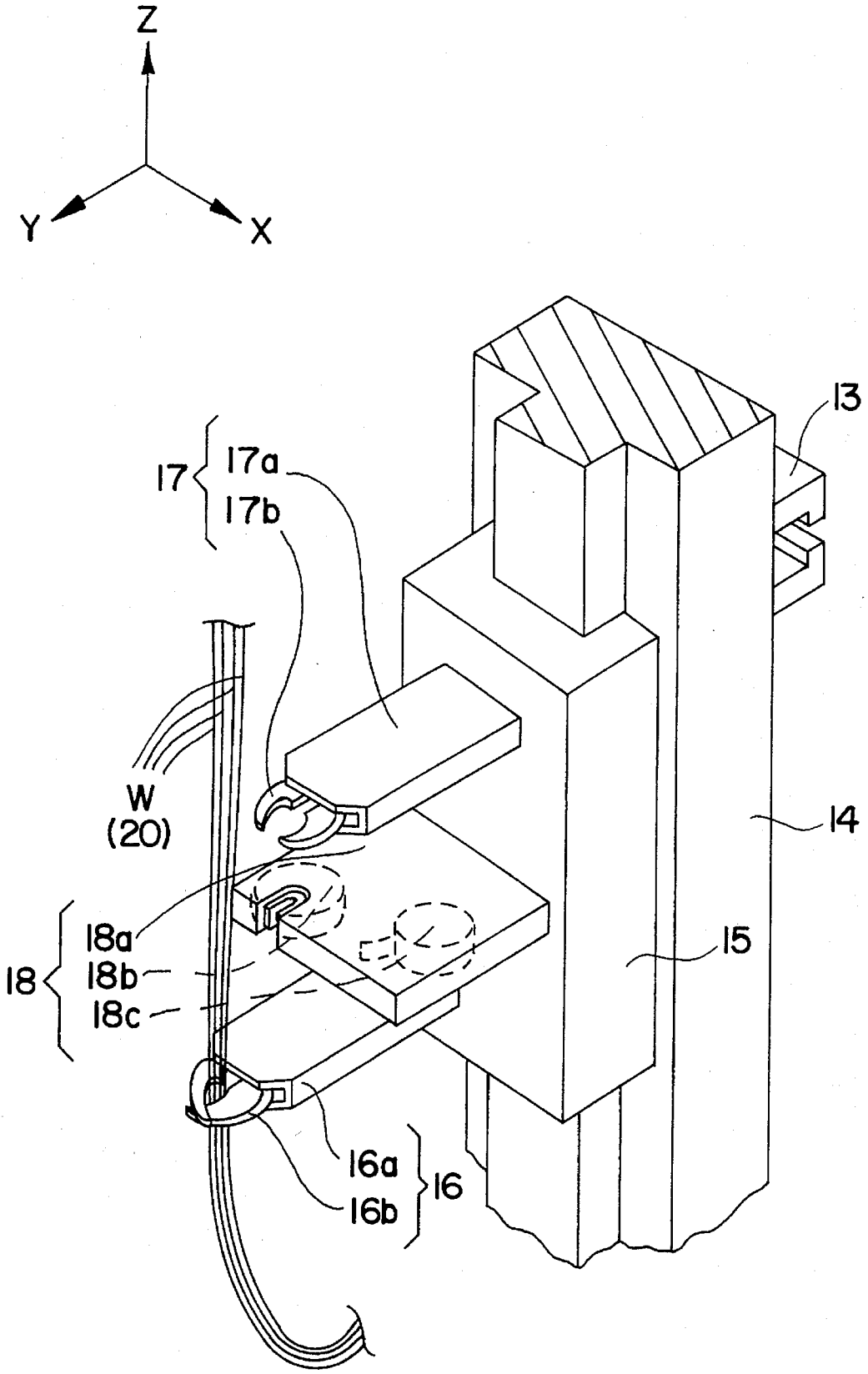
FIG. 3 is a schematic perspective view enlargedly showing an essential portion of the tape winding apparatus.

FIG. 3 is a schematic perspective view enlargedly showing an essential portion of tape winding apparatus 10.

As shown in FIG. 3, straightener 16 is mounted at the bottom part of the front surface of Z-direction movable member 15 and projects toward the housing retaining mechanism 9 in the Y-direction. Further, holder 17 is mounted at the upper part of the front surface of Z-direction movable member 15. Similar to straightener 16, holder 17 projects toward the retaining mechanism 9.

Straightener 16 and holder 17 are mostly comprised of the similar mechanical elements and include rectangular bodies 16*a*, 17*a*, and pairs of holding claws 16*b*, 17*b* mounted at leading ends of respective bodies 16*a*, 17*a* for holding parts of wires W at different positions, respectively. Further, straightener 16 and holder 17 include drive mechanisms (not shown) for driving holding claws 16*b*, 17*b* provided in the bodies 16*a*, 17*a*, respectively. These drive mechanisms are each comprised of mechanical elements such as an air cylinder and a helical spring and are individually controlled by controller 100 to be described later. The drive mechanism of straightener 16 is coupled with a switch mechanism for changing a holding force applied to wires W by holding claws 16*b* between two stages, so that holding claws 16 can hold wires W with two different holding forces.

Tape winder 18 projecting toward the housing retaining mechanism 9 is provided between straightener 16 and holder 17. Tape winder 18 includes rectangular body 18*a*. In body 18*a* is formed a notch opened toward the housing retaining mechanism 9 along the Y-direction. In body 18*a*, there are provided tape winding roller 18*b* having a notch corresponding to the notch formed in body 18*a* and tape supply mechanism 18*c* for supplying a piece of tape to roller 18*b*. Roller 18*b* and mechanism 18*c* are driven by the same motor (not shown) by way of a torque transmission mechanism for selectively transmitting a torque, similarly to the tape winding apparatus disclosed in Japanese Patent Application No. 4-220046 filed by the present applicant.

Figure 4:
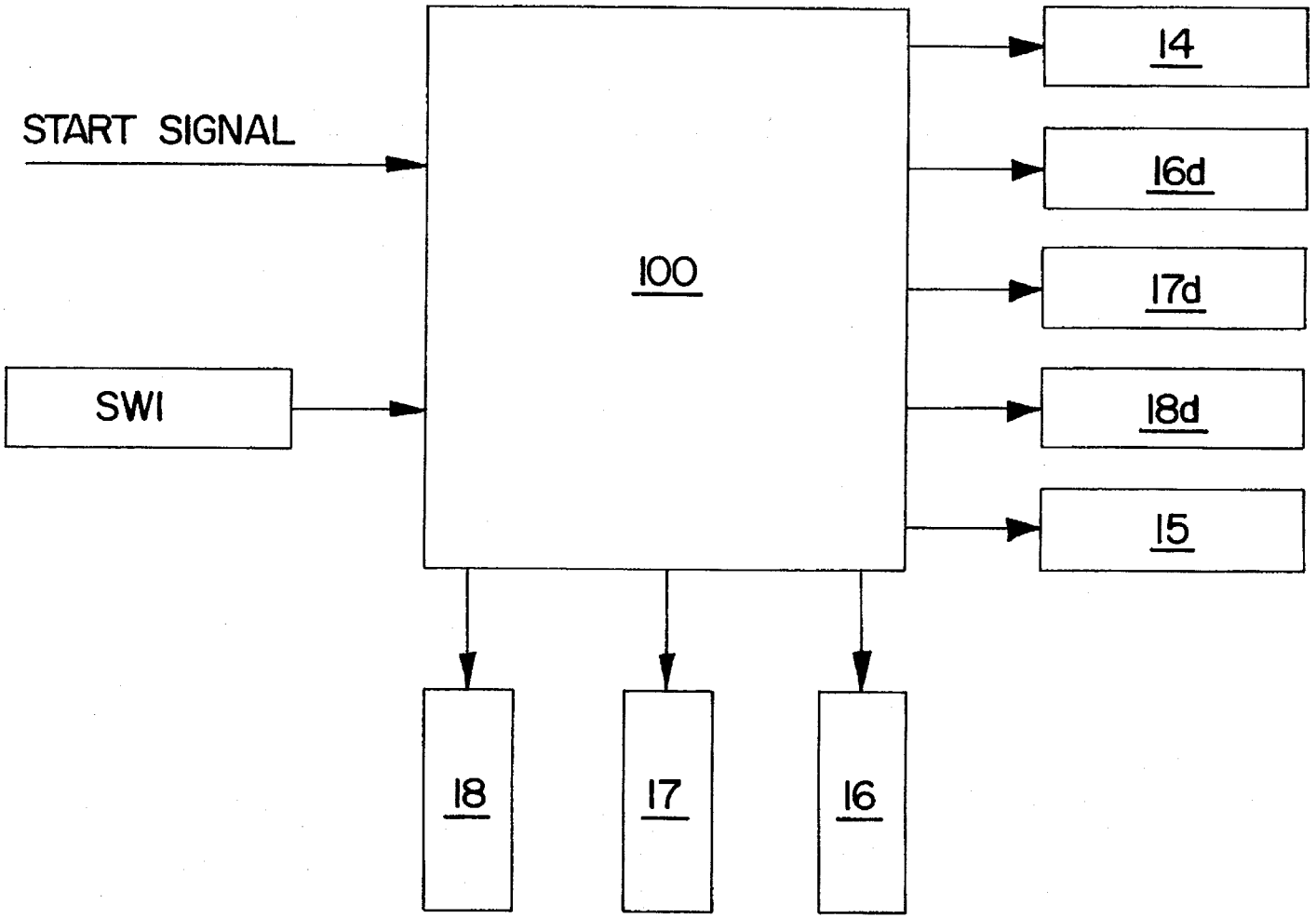
FIG. 4 is a block diagram showing the schematic construction of the tape winding apparatus.

Straightener 16, holder 17 and tape winder 18 are driven to move reciprocally in the Y-direction by straightener driver 16*d*, holder driver 17*d* and tape winder driver 18*d*, respectively (shown in the block diagram of FIG. 4). An air cylinder, a hydraulic cylinder or the like is employed as driving members.

The operation of the respective driving members to move movable member 14 in the X-direction, to move movable member 15 in the Z-direction and to move straightener 16, holder 17 and tape winder 18 in the Y-direction is controlled by controller 100.

FIG. 4 is a block diagram schematically showing the construction of tape winding apparatus 10.

With reference to FIG. 4, controller 100 is comprised of a microcomputer, an input/output interface, a relay circuit, and other wiring elements. Upon receipt of a start signal from the controller provided in terminal inserting mechanism 8 after terminals T are inserted, controller 100 individually drives the respective driving members in accordance with a specified program to be described later. Manual switch SW1 for forcibly starting and stopping the operation is connected with controller 100.

In place of the above construction, a switch for detecting completion of the operation of terminal inserting mechanism 8 may, for example, be provided between movable table 81 and terminal inserting head 82 shown in FIG. 2, so that a start signal is output upon completion of the operation of terminal inserting head 82.

Next, the operation of this embodiment is described in detail.

First with reference to FIG. 2, wires W sequentially processed by winding 1, cutting device 2, peeling device 3, peeling detector 4, terminal cramping devices 5 and wire transfer device 6 are conveyed to assembling apparatus M by terminal inserting mechanism 8.

Simultaneously with this wire processing step, connector housing feeder 7 transports palette 71 carrying connector housings C in the Y-direction toward assembling apparatus M by means of palette transport mechanism 73. When palette 71 is transported to the specified position, housing conveying device 74 operates and holding arms 74a pick up corresponding connector housings C with one stroke and convey them to assembling apparatus M. By this operation step, connector housings C are secured at the corresponding positions of housing retaining plate A facing housing feeder 7.

When connector housings C are secured, mount member 91 is rotated by 180° by driving device 93 so that retaining plate A carrying connector housings C faces terminal inserting mechanism 8. When mount member 91 is fixed and positioned by the unillustrated knock pin or the like after the rotation, terminal inserting head 82 of inserting mechanism 8 moves to insert terminals T into corresponding connector housings C.

The insertion of terminals T is accomplished in this way, and thereby intermediate wire assembly 20 is formed on housing retaining plate A as shown in FIG. 6(A). FIGS. 6(A) and 6(B) are schematic diagrams showing intermediate wire assembly 20 in this embodiment before and after the partial binding step, respectively.

Upon formation of intermediate wire assembly 20, the start signal representative of completion of the terminal insertion step is input to controller 100.

Thereafter, the partial binding step is started in the following procedure.

When the start signal is input to controller 100, mount member 91 is rotated by 180° by driving device 93 so that retaining plate A faces the connector feeder 7. Simultaneously with the rotation of mount member 91, X-direction movable member 14 is moved to the position opposed along the Y-direction to wires W to be bound as shown by wave form "a" in FIG. 5. In order to accomplish this movement of movable member 14, for example, controller 100 measures a driven amount of a driving source (e.g., motor) for movable member 14 by means of a counting means (e.g., rotary encoder) provided therein and stops the driving source when the measured value reaches a predetermined set value.

Figure 5:
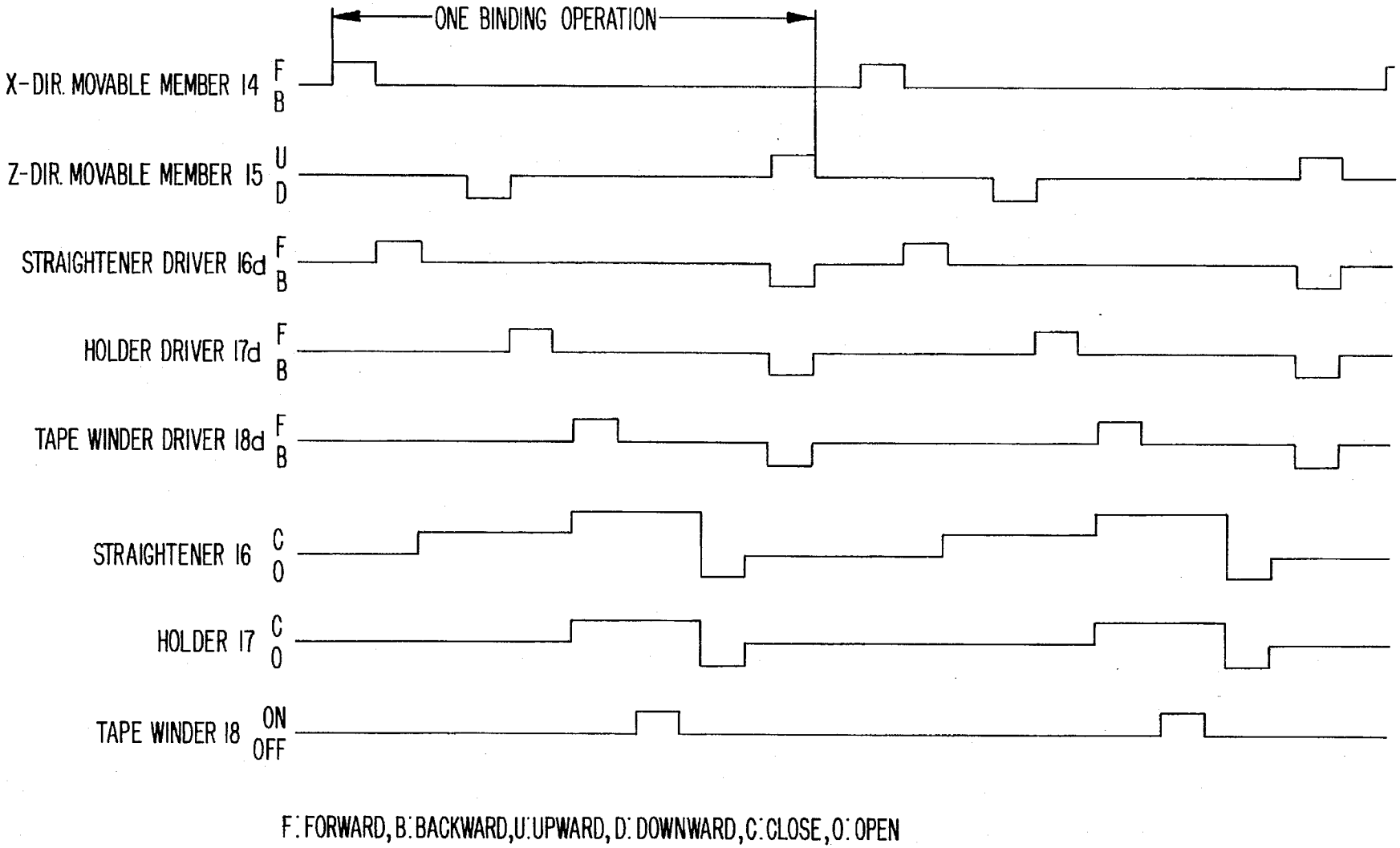
FIG. 5 is a timing chart of operation timings of the tape winding apparatus.

When movable member 14 is moved to the position opposed along the Y-direction to specified wires W, straightener 16 is driven to project toward wires W along the Y-direction as shown by wave form "b" in FIG. 5. This brings holding claws 16*b* of straightener 16 to such a position that they can hold a plurality of corresponding wires W.

Upon projection of straightener 16 along the Y-direction, controller 100 causes holding claws 16*b* of straightener 16 to hold wires W so as to bundle them as shown by wave form "c" in FIG. 5. In this embodiment, the holding force can be set at two different values. In this holding operation, holding claws 16*b* initially bundles wires W with a relatively feeble force.

When holding claws 16*b* of straightener 16 bundles wires W, Z-direction movable member 15 is moved downward as shown by wave form "d" in FIG. 5, thereby straightening bundled wires W. Thus, the bundle of wires W is pulled along the vertical direction, i.e., along the Z-direction while being straightened downward as shown in FIG. 3.

When the bundle of wires W is pulled, controller 100 drives holder driver 17*d* to move holding claws 17*b* of holder 17 to such a position that they can hold the bundle of wires W. Thereafter, the driving member for the holding claws 17*b* is actuated as shown by wave form "e" in FIG. 5, with the result that holder 17 firmly holds and fixes the bundle of wires W at the accurate position as shown by wave form "f" in FIG. 5.

In this embodiment, holding claws 16*b* of straightener 16 are driven again at the same time holding claws 17*b* of holder 17 are driven as shown by wave form "c" in FIG. 5, so that they hold wires W with a stronger force. Therefore, the wires W are firmly fixed at least in the portion between holding claws 16*b* and 17*b* by holding claws 16*b* and 17*b*.

When the bundle of wires W is fixed, tape winder driver 18*d* is driven as shown by wave form "g" in FIG. 5 so that tape winder 18 projects along the Y-direction and the leading end thereof is located at such a position as to wind tape around the bundle of wires W. Then, tape winding roller 18*b* (see FIG. 3) of tape winder 18 is driven as shown by wave form "h" in FIG. 5 to rotate by, for example, 720° (two turns) so as to apply bind B supplied by tape supply mechanism 18*c* to the bundle of wires W.

Upon completion of tape winding by roller 18*b*, holding claws 16*b*, 17*b* of straightener 16 and holder 17 are opened as shown by wave form "f" in FIG. 5 to release the taped or bound bundle of wires W. Thereafter, straightener driver 16*d*, holder driver 17d and tape winder driver 18*d* are driven again to retract straightener 16, holder 17 and tape winder 18 along the Y-direction, thereby completing the binding operation. Simultaneously with the retraction of straightener 16, holder 17 and tape winder 18, Z-direction movable member 15 is moved upward to return to the specified position.

The above operation is repeated as shown in a timing chart of FIG. 5 for showing operation timings of tape winding apparatus 10. In the case where the binding is applied at two positions of the same wire bundle, the binding is first applied at the upper position. Upon completion of this binding, Z-direction movable member 15 is slightly moved downward; straightener 16 is immediately caused to carry out a straightening step; and the binding is applied at the lower position substantially in the same manner as the above.

As described above, with the construction of this embodiment, the ends (portions where the cramping terminals T are secured) of wires W to be bundled are first inserted into connector housings C to thereby closely align wires W. The end portions of respective wires W are then automatically bound with tape after being straightened downward. Accordingly, the binding positions can be set in the vertical direction (Z-direction), thereby obviating the need to lay wires W over their entire lengths in the transport direction (X-direction) of the production line. As a result, the distance (distance along the X-direction) required to lay wires W can be shortened by the hanging amount of wires W, thereby considerably reducing the space required for the installation of the wire binding apparatus.

In the construction of this embodiment, wires W are connected with connector housings C on housing retaining mechanism 9 and hang downward in U-shape therefrom. Since the partial binding of wires W is carried out in cooperation with housing retaining mechanism 9, it can be done during a waiting period between the connecting step required to form one intermediate wire assembly ("terminal inserting step" in this embodiment) and the one required to form the next intermediate wire assembly. In this way, this embodiment allows the use of the waiting period between the two consecutive terminal inserting steps.

More specifically, in order to connect wires W with connector housings C, terminals T need to be connected with connector housings C after having performed the wire measuring step and wire cutting step by cutting device 2, the peeling step by peeling device 3, the terminal cramping step by terminal cramping devices 5 and other step(s). The respective steps carried out prior to the insertion of terminals T need to be sequentially carried out for each one of wires W. This results in a long waiting time between the two consecutive terminal inserting steps in assembling apparatus M. By utilizing such a long waiting period, the production efficiency of the entire production line can be improved according to this embodiment.

Further, in this embodiment, the binding is automatically applied to wires W to be bound which are pulled and fixed. Since wires W are firmly held between the ends thereof and the binding position, the automatic binding can be performed more easily.

Since the position of wires W where the partial bundling or binding is applied can be accurately fixed by employing straightener 16 which operates in cooperation with holder 17 in this embodiment, tape can be wound with improved accuracy and a defect rate of the products can be reduced. Particularly, since straightener 16 and holder 17 are disposed in vertical relationship and tape winder 18 is disposed therebetween, straightener 16 can also operate as a holding member. This leads to a reduction in the number of the parts and securely reinforces the holding force of holder 17.

The foregoing embodiment is nothing but the illustration of a preferred specific example of the invention and it goes without saying that the invention is not limited thereto.

For example, tape winding apparatus 10 may be installed separately from assembling apparatus M, e.g., at the downstream side of assembling apparatus M.

What is claimed is:

1. An apparatus for winding tape around a plurality of wires, each said wire having opposed first and second ends, said apparatus comprising:

holding means for gripping said plurality of wires in proximity to their respective first ends;

column means for supporting said holding means at a selected elevated position for permitting portions of said plurality of the wires spaced from the respective first ends thereof to hang from said holding means; and tape winding means supported on said column means and in proximity to said holding means for automatically winding portions of the plurality of wires with tape.

2. An apparatus according to claim 1, further comprising straightening means disposed in vertically spaced relationship from said holding means for straightening portions of said plurality of wires between said holding means and said straightening means.

3. An apparatus according to claim 2, wherein the tape winding means is disposed intermediate said holding means and said straightening means.

4. An apparatus according to claim 3, wherein said straightening means is below said holding means.

5. An apparatus according to claim 2, wherein at least one of said holding means and said straightening means is selectively movable toward and away from the other of said holding means and said straightening means.

6. An apparatus according to claim 5, wherein said straightening means is operative for selectively gripping said plurality of wires with a selected one of a higher force and a lower force, said lower force being of a magnitude for permitting sliding movement between said straightening means and said plurality of wires.

7. An apparatus according to claim 6, wherein said straightening means is operative for exerting said higher gripping force when said tape winding means is automatically winding the plurality of wires with said tape.

8. An apparatus for winding tape around a plurality of wires, each said wire having opposed first and second ends, said apparatus comprising:

a holding means for gripping said plurality of wires in proximity to the first ends thereof;

straightening means for straightening portions of the plurality of wires in proximity to said holding means; and tape winding means for automatically winding the straightened portions of said plurality of wires with tape.

9. An apparatus according to claim 8, wherein:

said straightening means holds the straightened wires in cooperation with the holding means;

the straightening means and the holding means are spaced from each other in a vertical direction; and the tape winding means is disposed between the straightening means and the holding means.

10. An apparatus according to claim 9, wherein the straightening means is operative for selectively generating either of first and second gripping forces, said second gripping force being less than said first gripping force and permitting slidable movement of said straightening means relative to said plurality of wires, said straightening means further being selectively movable relative to said holding means, and being operative for firstly gripping the wires with the second gripping force, and then moving away from the holding means, whereafter the straightening means is actuated for gripping the wires with the first gripping force before automatically winding the wires with the tape.

* * * * *